US006520998B1

(12) United States Patent
Scholler et al.

(10) Patent No.: US 6,520,998 B1
(45) Date of Patent: Feb. 18, 2003

(54) PLUG SOCKET WITH HIGH-CURRENT CONTACT

(75) Inventors: Johann Scholler, Deggendorf (DE); Hans ten Pas, Deggendorf (DE)

(73) Assignee: Interconnectron GmbH, Deggendorf (DE)

( * ) Notice: Subject to any disclaimer, the term of this patent is extended or adjusted under 35 U.S.C. 154(b) by 0 days.

(21) Appl. No.: 09/653,175

(22) Filed: Aug. 31, 2000

(30) Foreign Application Priority Data

Aug. 31, 1999 (DE) ..... 199 41 515

(51) Int. Cl.[7] ..... H01R 11/22
(52) U.S. Cl. ..... 849/851; 439/843
(58) Field of Search ..... 439/851, 842, 439/843

(56) References Cited

U.S. PATENT DOCUMENTS 3,107,966 A * 10/1963 Bonhomme ..... 439/843
3,123,429 A * 3/1964 Anderson et al. ..... 439/843
4,752,253 A * 6/1988 Neumann et al. ..... 439/851
5,055,055 A * 10/1991 Bakker ..... 439/851
5,676,571 A * 10/1997 Matthews ..... 439/839
6,102,746 A * 8/2000 Nania et al. ..... 439/843

FOREIGN PATENT DOCUMENTS

DE 3528587 * 2/1987 ..... 439/851
DE 3606340 * 9/1987 ..... 439/851
EP 0401723 * 12/1990 ..... 439/851

* cited by examiner

*Primary Examiner*—Tho D. Ta
(74) *Attorney, Agent, or Firm*—Sidley Austin Brown & Wood, LLP

(57) ABSTRACT

A plug socket for establishing a high-current electrical connection and including a metal body formed along a portion of its longitudinal extent as a hollow cylinder section, and a contact spring jack received in the hollow cylinder section and having a plurality of linear, substantially hyperbolically extending, contact elements connected at their opposite ends by respective circumferential material bands, with the contact spring jack being anchored, at its rear, with respect to a plug-in direction of an associated contact pin, end in the hollow cylinder section with a press fit, and with its front, in the plug-in direction of the associated contact pin, end forming a sliding fit connection with the hollow cylinder section.

7 Claims, 3 Drawing Sheets

PLUG SOCKET WITH HIGH-CURRENT CONTACT

BACKGROUND OF THE INVENTION

1. Field of the Invention

The present invention relates to a plug socket with a high-current contact for establishing a high-current electrical connection, comprising a metal body formed along a portion of its longitudinal extent as a hollow cylinder section and a contact spring jack received in the hollow cylinder section and having a plurality of linear, substantially hyperbolically extending, contact elements connected at their opposite ends by respective circumferential material bands, with the contact spring jack being secured, at one of its opposite ends, in the metal body without a possibility of axial displacement.

2. Description of the Prior Art

A plug socket with a high-current contact is disclosed in patent No. 67,484 of the former German Democratic Republic. In the structure disclosed in this patent, a metal body in which a form-stable contact spring jack is received, is formed of two parts. The metal body consists of a so-called solder connector bolt and a sleeve encompassing the contact spring jack. The metal body is formed as a unitary element by pressing into the sleeve stays for the soldered connector bolt, with the contact spring jack being pressed in with its inner end metal band between the connector bolt stays and the jack encompassing sleeve. This construction is based on an assumption that the main load, upon establishing of the plug-in connection, acts in the direction of the plug socket bottom and, therefore, a support of the contact spring jack against a radially protruding collar of the solder connector bolt is sufficient to take up the main load, which is generated upon establishing of a releasable plug-in connection, and is applied to the plug socket. To insure a sufficient reliability of the press connection between the solder connector bolt and the contact spring jack and the jack-encompassing sleeve and for purposes of economical manufacturing of the plug socket, it was deemed sufficient to provide knurling in stays for the soldered connector bolt which engage the contact spring jack or the jack-encompassing sleeve.

However, the question remains whether in view of unavoidable tolerances and, in particular, tolerance pairing, necessary in mass production, the foregoing assumption for a plug socket with high-current contact of this type is valid or not. This is because the multi-part construction requires noticeable production expenses for both manufacturing and the assembly with a following alignment and pressing of the three separate parts of the plug socket.

In order to eliminate or to reduce the drawbacks associated with this type of plug sockets and connected with the relatively high production expenses or with mechanical rigidity, German patent No. 3,528,587 proposes to provide the stays of the soldered connector bolt, which engage the jack-receiving sleeve, upon assembly of the plug socket, with a radial constriction. Thereby, upon connection of the soldered connector bolt with the sleeve, a formlocking support is formed between the soldered connector bolt and the jack-receiving sleeve in the plug-in direction, preventing the displacement of the jack in the plug-in direction. This formlocking support insures the integrity of the plug socket when the jack-receiving sleeve, together with the jack, is pressed against the stays constriction and is supported thereagainst.

Though the radial constriction permits to achieve a reliable formlocking, tolerance-insensitive support in an axial direction, at least within certain limits, of the separate elements of the plug socket, other drawbacks such as, e.g., as high production costs, which are connected with a need to produce a multi-part socket, remain.

In another type of plug sockets with high-current contact for establishing an electrical plug-in connection, the jack encompassing sleeve and the soldered connector bolt are formed as a one-piece part. However, in these plug sockets, such as shown and described in European publication EP-0 653 808, the free front end of the spring jack is connected with the jack-receiving sleeve by a press fit and, possibly, other formlocking means. The rear end of the contact spring jack is axially and radially spaced with respect to the jack-receiving sleeve or from a surface defining a hollow space provided in a metal body. The plug socket shown in this European Publication has a simplified construction and fewer parts, which simplifies its assembly. However, with this construction, the advantage of a formlocking support for the contact spring jack in the plug-in direction is given up.

Accordingly, an object of the present invention is to provide a plug socket with a high-current contact which can be cost-effectively produced.

Another object of the present invention is to provide a mechanically rigid, in opposite plug-in directions, plug socket formed of only two parts.

A further object of the present invention is to provide a plug socket the operational characteristics of which are independent form manufacturing tolerances to a most possible extent.

SUMMARY OF THE INVENTION

These and other objects of the present invention, which will become apparent hereinafter, are achieved by providing a plug socket with the contact spring jack anchored, at its rear, with respect to a plug-in direction, end in the hollow cylinder section with a press fit, and with its front, in the plug-in direction, end forming a sliding fit connection with the hollow cylinder section.

With this construction, together with the smallest possible manufacturing expenses for all parts and completely independent of the quality of the press fit between the contact spring jack and the inner wall of the hollow cylinder-defining bore, an absolutely reliable formlocking support of the contact spring jack in the plug-in direction of the associated connection pin in the metal body achieved. This advantage is insured, completely independent of tolerances, when the contact spring jack is defined as a rolled-up sleeve formed of a sheet metal strip and with contact strips defined by punched-out sections. Such a sleeve substantially reduced total costs of production of a plug socket with high-current contact. An additional advantage of the structure according to the present invention consists in that in case when necessary or desirable, the contact spring jack can be secured against displacement in the pull-out direction of the associated contact pin in a simple manner during an operational step in which the contact spring jack is inserted in the hollow cylinder section of the metal body.

According to an advantageous embodiment of the present invention, the hollow cylinder section of the metal body has, at its inner end, a radially widened inner diameter portion. This enables, in the same operation step, i.e., without additional expenses, simultaneously with formation of the press fit between the rear or inner band of the contact spring jack and the inner wall of the hollow cylinder portion, to form of formlocking connection of the two parts, the contact spring jack and the metal body, with respect to the pull-out direction of the contact pin which cooperates with the plug socket. It is particularly advantageous when the depth of the radially widened inner diameter portion corresponds at least to a portion of the thickness of the material band connecting the contact wires or contact strips of the contact spring jack with each other.

In connection with the securing one end of the contact spring jack without a possibility of axial displacement at the bottom of the hollow cylinder of the metal body, the end of the contact spring jack adjacent to the free end of the hollow cylinder forms a sliding fit therewith. Thereby, a length equalization between contact strips of the contact spring jack movable outwardly upon insertion of the contact pin into the jack, is insured. In accordance with a particularly preferred embodiment of the present invention, which insures an exact guidance of the free end of the contact spring jack, the hollow cylinder section of the metal body has, at its outer free end, a radially widened inner diameter portion formed as a cylindrical portion over a major portion of an axial extent of the associated metal band of the contact spring jack. Preferably, the depth of the inner diameter portion is relatively small so that the circumferential material band, which forms the free end of the contact spring jack contacts the inner circumference of the cylinder without any noticeable pressure and forms therewith only sliding fit.

In order to additionally secure the contact spring jack in the direction of which the contact pin is pulled-out, the hollow cylinder section has, in a region of its outer end, at least at one location of its circumference a directed radially inward, reduce inner diameter portion.

According to a simplified embodiment of the present invention, the reduced inner diameter portion can be formed as a bead engaging an outer end surface of the metal strip which is provided at the free end of the contact spring jack.

However, within the scope of the present invention, means for an additional securing of the contact spring jack in the axial direction is not limited to the bead, and the reduced inner diameter portion can be formed as a directed radially inward projection.

In accordance with still further embodiment of the present invention, the metal body can have, at its end, opposite the hollow cylinder section, a section for connection with a stranded cord or conductor, which is formed integrally with the hollow cylinder section. At that, the metal body can be formed as a one-piece rotatable member having a reduced diameter section connecting the hollow cylinder section with the connection section.

However, the plug socket according to the present invention is not limited to the above-discussed embodiments and can be formed, e.g., of a radially deformable metal pipe section or of a similar semi-finished morkpiece.

The novel features of the present invention, which are considered as characteristic for the invention, are set forth in the appended claims. The invention itself, however, both as to it construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
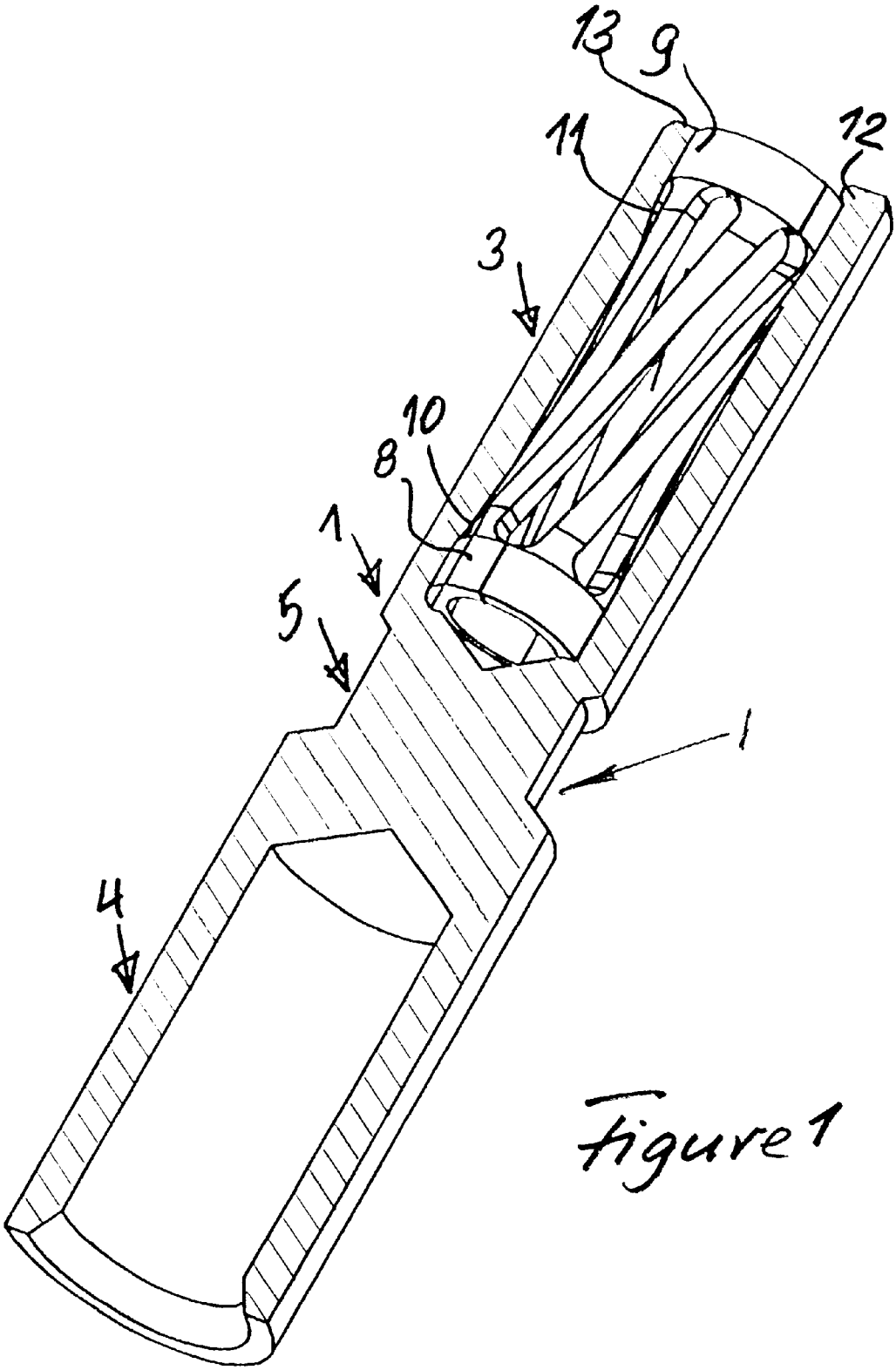
FIG. 1 a cross-sectional view of a plug socket with a high-current contact according to the present invention.
Figure 2:
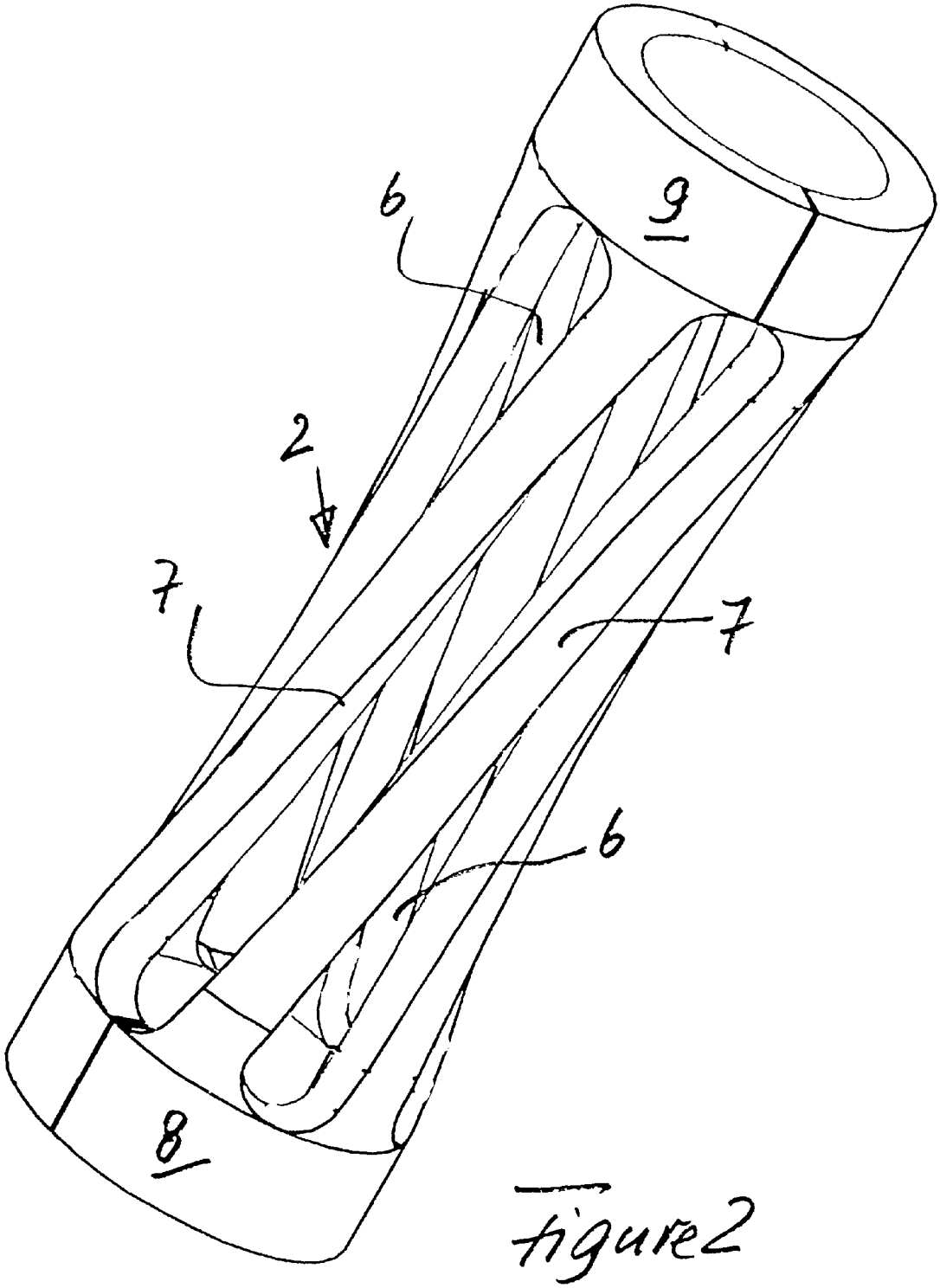
FIG. 2 a perspective view of a contact spring jack of a plug socket provided with a high-current contact according to the present invention.
Figure 3:
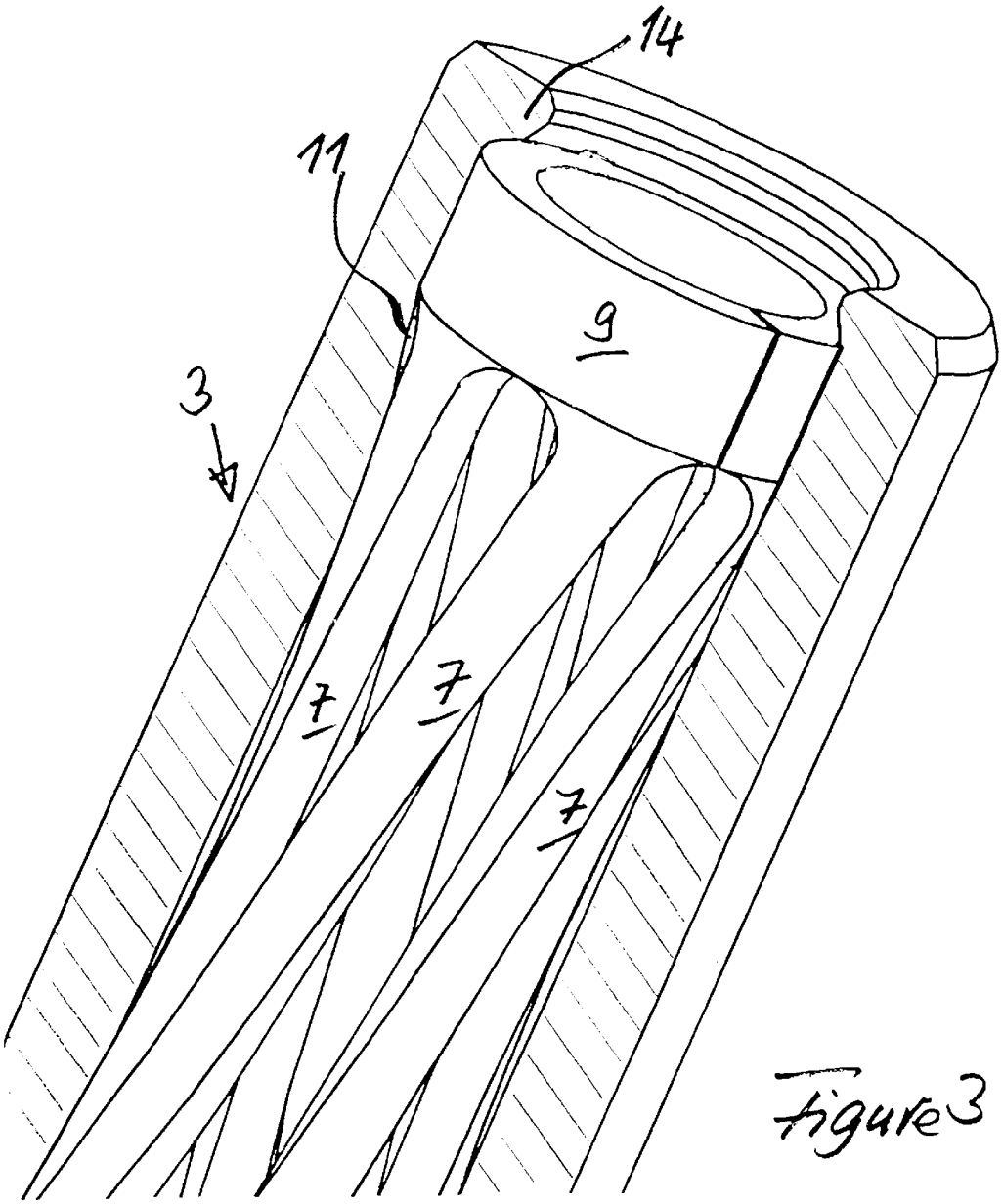
FIG. 3 a cross-sectional view of free end of another embodiment of a plug socket with a high-current contact according to the present invention.

A plug socket with a high-current contact according to the present invention, which is shown in FIGS. 1–3, includes a socket formed as a one-piece metal body 1 and a contact spring jack 2 received therein. The socket-forming metal body 1 is formed as a rotatable body and consists of three sections, namely, an elongate section 3 formed as a hollow cylinder for receiving the contact spring jack 2, an opposite elongate section 4 likewise formed as a hollow cylinder for connection with a stranded conductor (not shown) and a massive section 5 which connects the opposite elongate sections 3 and 4 and which has a reduced diameter in comparison with the diameter(s) of the elongate sections 3 and 4. The contact spring jack 2 is formed as a rolled-up section of a strip of sheet material, with the contact strips 7 being defined by punch-out sections 6 and connected, at their opposite ends, by material bands 8 and 9. Generally, the contact strips 7 of the contact spring jack 2 extend in a hyperbolic direction. In the receiving section 3 of the metal body 1, the contact spring jack 2 is secured, on one hand, by a press fit connection between the inner circumference of the hollow cylinder, which is formed by the receiving section 3, and the rear with respect to the plug-in direction of the associated contact pin, material band 8 and, on the other hand, by a sliding fit connection between the inner circumference of the hollow cylinder and the front, with respect to the plug-in direction of the associated contact pin, material band 9. In the embodiment shown in FIG. 1, the hollow cylinder, which is formed by elongate section 3, has, in the regions of the material bands 8 and 9, respective widened inner diameter portions 10 and 11, with the portion 10 providing, at least over a part of its circumference, an additional formlocking anchoring of the contact spring jack 2 in the hollow cylinder of the metal body section 3. The additional securing of the contact spring jack 2 in the receiving section 3 is effected with a directed radially inward projection 12 of the free rim 13 of the receiving section 3 of the metal body 1.

A plug socket which is shown in the embodiment shown in FIG. 3, distinguishes form that shown in FIG. 1 in that additional securing of the contact spring jack 2 in the hollow cylinder of the receiving section 3, is effected with a directed radially inward bent section 14 of the rim of the receiving section 3.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A plug socket for establishing a high-current electrical connection, comprising a metal body formed along a portion of a longitudinal extent thereof as a hollow cylinder section; and a contact spring jack formed of a sheet metal strip as a rolled-up sleeve, received in the hollow cylinder section, and having a plurality of linear, substantially hyperbolically extending, contact elements connected at opposite ends thereof by respective circumferential material bands, wherein the contact spring jack is anchored, at a rear, with respect to a plug-in direction of an associated contact pin, end thereof, in the hollow cylinder section with a press fit, with a front, in the plug-in direction of the associated contact pin, end of the contact spring jack forming a sliding fit connection with the hollow cylinder section;

wherein the hollow cylinder section of the metal body has, at an inner end thereof, a radially widened inner diameter portion, and at an outer end thereof, a radially widened inner diameter portion formed as a cylindrical portion over a major portion of an axial extent of a respective one of circumferential material band of the contact spring jack.

2. A plug socket as set forth in claim 1, wherein the hollow cylinder section has, in a region of the outer free end thereof, at least at one location of a circumference thereof, a directed radially inward, reduced inner diameter portion.

3. A plug socket as set forth in claim 2, wherein the reduced inner diameter portion is formed as a bead engaging an outer end surface of the metal strip provided at the free end of the contact spring jack.

4. A plug socket as set forth in claim 2, wherein the reduced inner diameter portion is formed as a directed radially inward projection.

5. A plug socket as set forth in claim 4, wherein the directed radially inward projection is formed as a projection of a free end surface of the hollow cylinder section of the metal body.

6. A plug socket as set forth in claim 1, wherein the metal body has, at an end thereof opposite the hollow cylinder section, a section for connection with a stranded cord.

7. A plug socket as set forth in claim 6, wherein the metal body is formed as a one-piece rotatable body having a reduced diameter section connecting the hollow cylinder section and the connection section.

* * * * *